US006986949B2

(12) United States Patent
Mertins

(10) Patent No.: US 6,986,949 B2
(45) Date of Patent: Jan. 17, 2006

(54) FUGITIVE PATTERNS FOR INVESTMENT CASTING

(75) Inventor: Michael W. Mertins, Wichita Falls, TX (US)

(73) Assignee: Howmet Corporation, Cleveland, OH (US)

( * ) Notice: Subject to any disclaimer, the term of this patent is extended or adjusted under 35 U.S.C. 154(b) by 0 days.

(21) Appl. No.: 10/304,144

(22) Filed: Nov. 25, 2002

(65) Prior Publication Data

US 2003/0075296 A1 Apr. 24, 2003

Related U.S. Application Data

(62) Division of application No. 09/862,985, filed on May 22, 2001, now Pat. No. 6,505,672.

(51) Int. Cl.

| | |
|---|---|
| ***B22D 25/02*** | (2006.01) |
| ***B32B 15/00*** | (2006.01) |
| ***B22F 5/00*** | (2006.01) |
| ***F01D 5/12*** | (2006.01) |

(52) U.S. Cl. ..... 428/582; 428/598; 428/577; 428/583; 416/248

(58) Field of Classification Search ..... 428/582, 428/577, 583, 598; 416/223 R, 248, 234
See application file for complete search history.

(56) References Cited

U.S. PATENT DOCUMENTS

| | | | | |
|---|---|---|---|---|
| 3,656,222 A | | 4/1972 | Jones | 29/156.8 H |
| 3,695,342 A | | 10/1972 | Petit | 164/268 |
| 3,844,334 A | * | 10/1974 | Frederickson | 164/132 |
| 4,055,213 A | | 10/1977 | Maher | 164/45 |
| 4,068,702 A | | 1/1978 | Herold | 164/30 |
| 4,108,931 A | | 8/1978 | Ogden | 264/37 |
| 4,172,489 A | | 10/1979 | Lefebvre | 164/309 |
| 4,276,922 A | | 7/1981 | Brookes | 164/27 |
| 4,283,835 A | | 8/1981 | Obrochta et al. | 164/45 |
| 4,289,191 A | | 9/1981 | Myllymaki | 164/45 |
| 4,384,607 A | | 5/1983 | Wood et al. | 164/132 |
| 4,416,322 A | | 11/1983 | Tremeaux | 164/340 |
| 4,417,381 A | | 11/1983 | Higginbotham | 29/156.8 H |
| 4,472,092 A | | 9/1984 | Schmidt | 164/35 |
| 4,478,299 A | * | 10/1984 | Dorosz | 175/369 |
| 4,577,669 A | | 3/1986 | Schmidt et al. | 164/45 |
| 4,806,729 A | | 2/1989 | Holmes et al. | 219/121.63 |
| 4,836,266 A | | 6/1989 | Wuepper et al. | 164/29 |
| 4,905,752 A | | 3/1990 | Rama Prasad | 164/122.1 |
| 4,919,193 A | | 4/1990 | Sasaki | 164/516 |
| 5,176,188 A | | 1/1993 | Quinn et al. | 164/516 |
| 5,271,451 A | | 12/1993 | Chandley et al. | 164/63 |
| 5,285,839 A | | 2/1994 | Van Rens | 164/34 |
| 5,465,780 A | | 11/1995 | Muntner et al. | 164/516 |
| 5,503,218 A | | 4/1996 | Campion et al. | 164/516 |

(Continued)

FOREIGN PATENT DOCUMENTS

| | | |
|---|---|---|
| EP | 247 821 | 12/1987 |

(Continued)

*Primary Examiner*—Michael E. Lavilla
(74) *Attorney, Agent, or Firm*—Edward J. Timmer

(57) ABSTRACT

A fugitive pattern of an article to be investment cast wherein the pattern includes a plurality of locator embossments disposed in an array to provide a datum reference system by which the pattern can be held and positioned by a manipulator, such as for example a gripper device to a computer controlled robotic device, for assembly with another component of the pattern assembly. The datum embossments are located on a portion of the pattern that will be removed from the final metallic casting made to replicate the pattern. The casting includes integral cast datum embossments thereon by which the casting can be held and positioned.

10 Claims, 13 Drawing Sheets

U.S. PATENT DOCUMENTS

| | | | | |
|---|---|---|---|---|
| 5,735,335 | A | 4/1998 | Gilmore et al. | 164/516 |
| 5,841,669 | A * | 11/1998 | Purvis et al. | 364/554 |
| H1769 | H | 1/1999 | LeClair et al. | 164/6 |
| 5,869,194 | A * | 2/1999 | Dwyer | 428/542.8 |
| 5,900,278 | A * | 5/1999 | Coffinberry et al. | 427/227 |
| 6,068,806 | A | 5/2000 | Dietrich | 264/219 |
| 6,109,333 | A * | 8/2000 | Pontzer | 164/34 |
| 6,457,941 | B1 * | 10/2002 | Larzelere et al. | 416/144 |
| 6,505,678 | B2 * | 1/2003 | Mertins | 164/516 |

FOREIGN PATENT DOCUMENTS

| | | |
|---|---|---|
| FR | 2 674 793 | 10/1992 |
| FR | 2 685 230 | 6/1993 |
| GB | 2 372 953 A | 9/2002 |
| JP | 3-216 237 | 9/1991 |
| JP | 5-253 641 | 10/1993 |

* cited by examiner

FUGITIVE PATTERNS FOR INVESTMENT CASTING

This is a division of Ser. No. 09/862,985 filed May 22, 2001, now U.S. Pat. No. 6,505,672.

FIELD OF THE INVENTION

The present invention relates to investment casting of metallic materials and to fugitive patterns for use in the investment casting process, pattern assemblies and apparatus for assembling patterns.

BACKGROUND OF THE INVENTION

In the well known "lost wax" process of investment casting, a fugitive or disposable wax pattern is made by injection molding melted wax in a die corresponding to the configuration of the article to be cast. Typically, each wax pattern includes integral wax gating. A plurality of such molded wax patterns then are joined to a common wax runner bar by wax welding the gating to the runner bar. A frusto-conical or other wax pour cup typically is wax welded to the runner bar to complete the pattern assembly. The pattern assembly is invested in a ceramic shell mold by repeatedly dipping the pattern in a ceramic slurry, draining excess slurry, stuccoing with coarse ceramic particles or stucco, and air drying until a desired thickness of a ceramic shell mold is built-up on the pattern assembly. The pattern assembly then is removed from the green shell mold typically by heating the shell mold to melt out the pattern assembly, leaving a ceramic shell mold which then is fired at elevated temperature to develop appropriate mold strength for casting a molten metal or alloy.

In the past, the wax patterns have been wax welded manually to the wax runner bar. Such manual wax welding is disadvantageous in that it is time consuming and costly as a result and also produces pattern assemblies that exhibit high variability from one pattern assembly to the next with respect to dimensional locations of the patterns on the runner bar and the strength of the wax weld between the pattern gating and the runner bar from one pattern to the next on the runner bar. Improper pattern positioning on the runner bar and breaking off of some patterns at the wax weld can occur.

An object of the invention is to provide a fugitive pattern and method of making a fugitive pattern assembly for use in the lost wax precision investment casting process that overcome the above disadvantages.

Another object of the invention is to provide apparatus for manipulating a fugitive pattern to position it relative to another component of a pattern assembly.

Another object of the invention is to provide an investment casting having features adapted to be engaged by a manipulator.

SUMMARY OF THE INVENTION

The present invention provides in one embodiment a fugitive pattern of an article to be investment cast wherein the pattern includes a plurality of locators disposed in an array to provide a datum reference system by which the pattern can be held and positioned by a manipulator, such as for example a gripper device pursuant to another embodiment of the invention coupled to a computer controlled robotic motion device, for assembly with another component of a pattern assembly. Preferably, the datum locators are located on a portion of the pattern that will be removed from the final metallic casting made to replicate the pattern. For example, the datum locators preferably are located on a gating region of the fugitive pattern such that the metallic gating is cut-off from the final casting in a one step cut-off operation.

In a particular embodiment of the invention, a plurality of locator embossments on the fugitive (e.g. wax) pattern define a reference plane that is positioned parallel to a plane of orientation determined for the surface of a fugitive (e.g. wax) support member, such as a runner bar. Prior to placing the attaching surface of the fugitive pattern in proximity to and facing the surface of the fugitive support member, a sensor on the gripper device is moved over the surface of the support member by the robotic motion device to determine planar orientation of a particular area of the support member surface where each successive pattern is to be attached, which planar orientation is stored in robot control unit memory. When the pattern attaching surface is then placed proximate and facing the area of the surface of the support member, the gripper device is manipulated by the robotic arm to orient the pattern attaching surface so as to have substantially the same orientation as the sensed and stored planar orientation.

The present invention provides in another embodiment a method of making a fugitive pattern assembly by placing an attaching surface of a fugitive pattern in proximity to and facing a surface of a fugitive support member, such as for example, a wax runner bar. A heating device is placed between the attaching surface of the pattern and the surface of the support member to melt a puddle of the fugitive material on the surface of the support member and soften but not melt the pattern attaching surface. The heating device is removed. The pattern and support member then are relatively moved to contact the pattern attaching surface and the melted puddle, which is solidified during such contact to form a joint therebetween. Preferably, the pattern is manipulated by a robotic device in a manner that the attaching surface of the pattern is first moved a preselected distance below the surface of the melted puddle and then moved in an opposite direction a lesser preselected distance to form a smooth filleted corner at the joint between the pattern and the support member.

The invention provides in another embodiment a gripper device for gripping a fugitive pattern to accurately position it relative to another component of a pattern assembly. The gripper device preferably includes a position sensing device and heating device that is movable in a manner to melt a puddle of pattern material on the component to be assembled to the pattern.

The fugitive pattern having the above locators thereon is used in the lost wax investment casting process to cast an article that includes a plurality of integral locators disposed in an array to provide a datum reference system by which the cast article can be held and positioned by a manipulator for further processing.

Objects and advantages of the invention will become more readily apparent from the following detailed description.

DETAILED DESCRIPTION OF THE INVENTION

The present invention provides a fugitive pattern and a fugitive pattern assembly for use in the lost wax investment casting process employed in the high volume commercial production of metal and alloy cast articles. The invention is described below for purposes of illustration, and not limitation, in relation to a fugitive pattern for making a pattern assembly for use in the lost wax investment casting of precision nickel and cobalt superalloy components, such as gas turbine engine blades and vanes having airfoil shapes, although the invention is not limited in this regard and can be practiced using other patterns to make pattern assemblies for use in the lost wax investment casting of any metal or alloy to make any article. The invention is especially useful to make a pattern assembly having a plurality of wax patterns joined to a wax runner bar or any other wax component of the pattern assembly. The patterns, runner bar, and other component of the pattern assembly can be made of any suitable fugitive pattern material, such as conventional pattern wax, solid or foam plastic (e.g. polymeric foam such as polyurethane foam).

Figure 1:
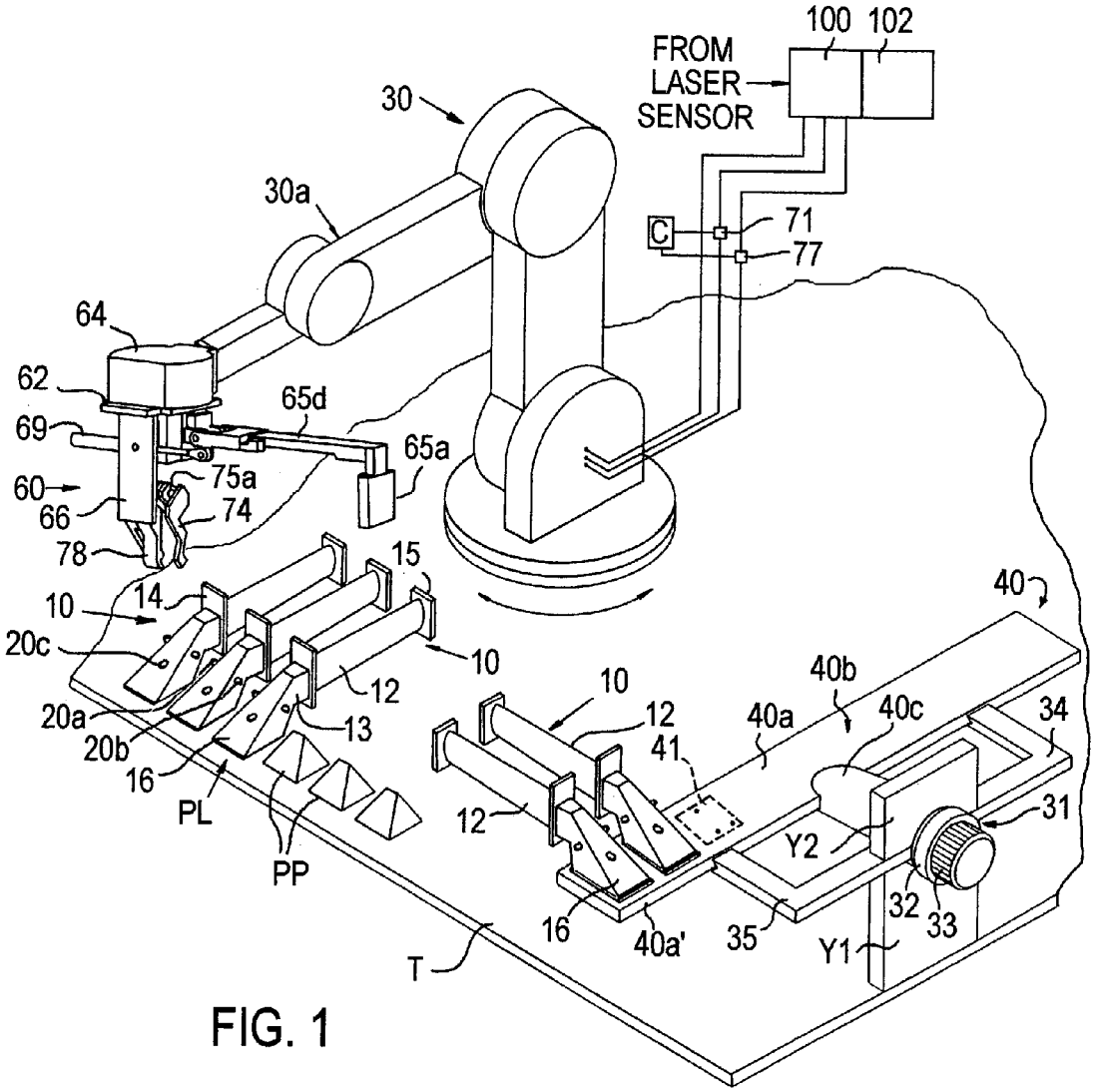
FIG. 1 is a perspective view of a robotic device for use in positioning a plurality of wax airfoil patterns relative to a wax runner bar for welding thereto to form a pattern assembly pursuant to an embodiment of the invention.
Figure 1A:
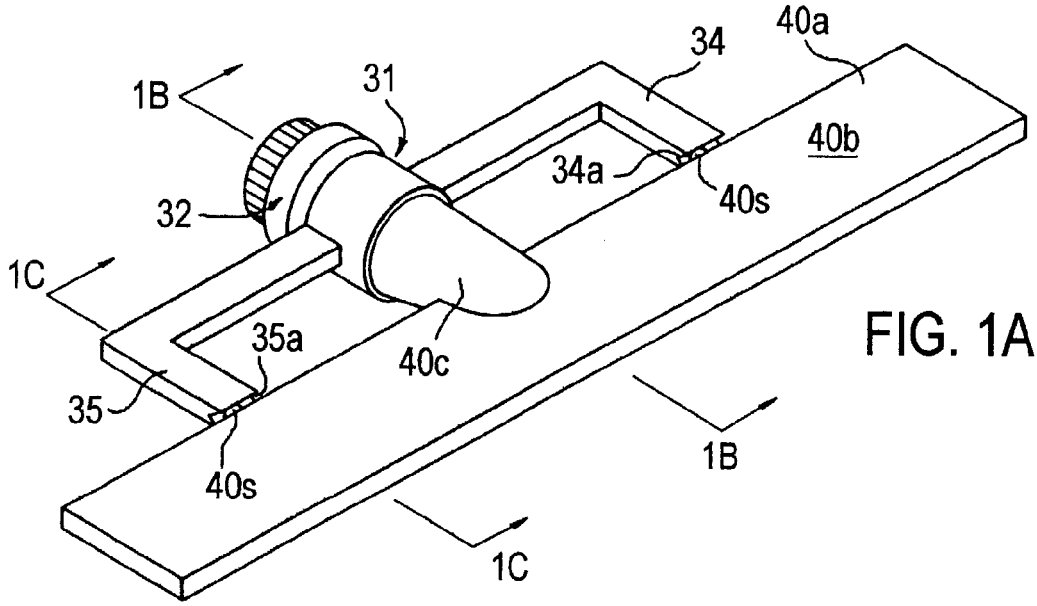
FIG. 1A is a perspective view of a fixture for holding the runner bar.
Figure 1B:
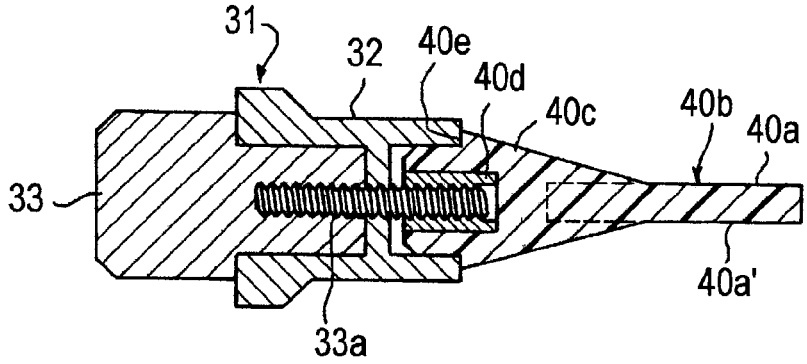
FIG. 1B is a sectional view taken along lines 1B—1B of FIG. 1A.
Figure 1C:
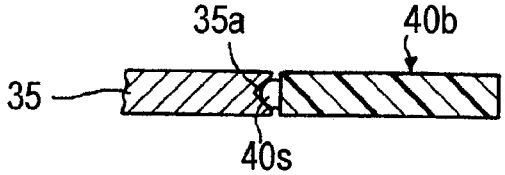
FIG. 1C is a sectional view taken along lines 1C—1C of FIG. 1A.

Referring to FIG. 1, a plurality of individual fugitive (e.g. wax) patterns 10 having a shape of a gas turbine engine airfoil blade are shown. The patterns 10 each include an airfoil region 12, root region 13, platform region 14, optional shrouded tip region 15, and gating region 16, FIG. 2. The patterns 10 typically are injection molded of conventional pattern wax although other pattern materials and pattern making methods can be employed.

Pursuant to the invention, each pattern 10 is injected to include a plurality of datum locators illustrated as datum embossments 20*a*, 20*b*, 20*c* disposed in an array to provide a datum reference system on each pattern by which each pattern can be held and positioned by a manipulator, such as for example a gripper device 60 pursuant to the invention coupled to a computer controlled robotic device 30, FIG. 1, for assembly with another component of the pattern assembly.

Figure 6:
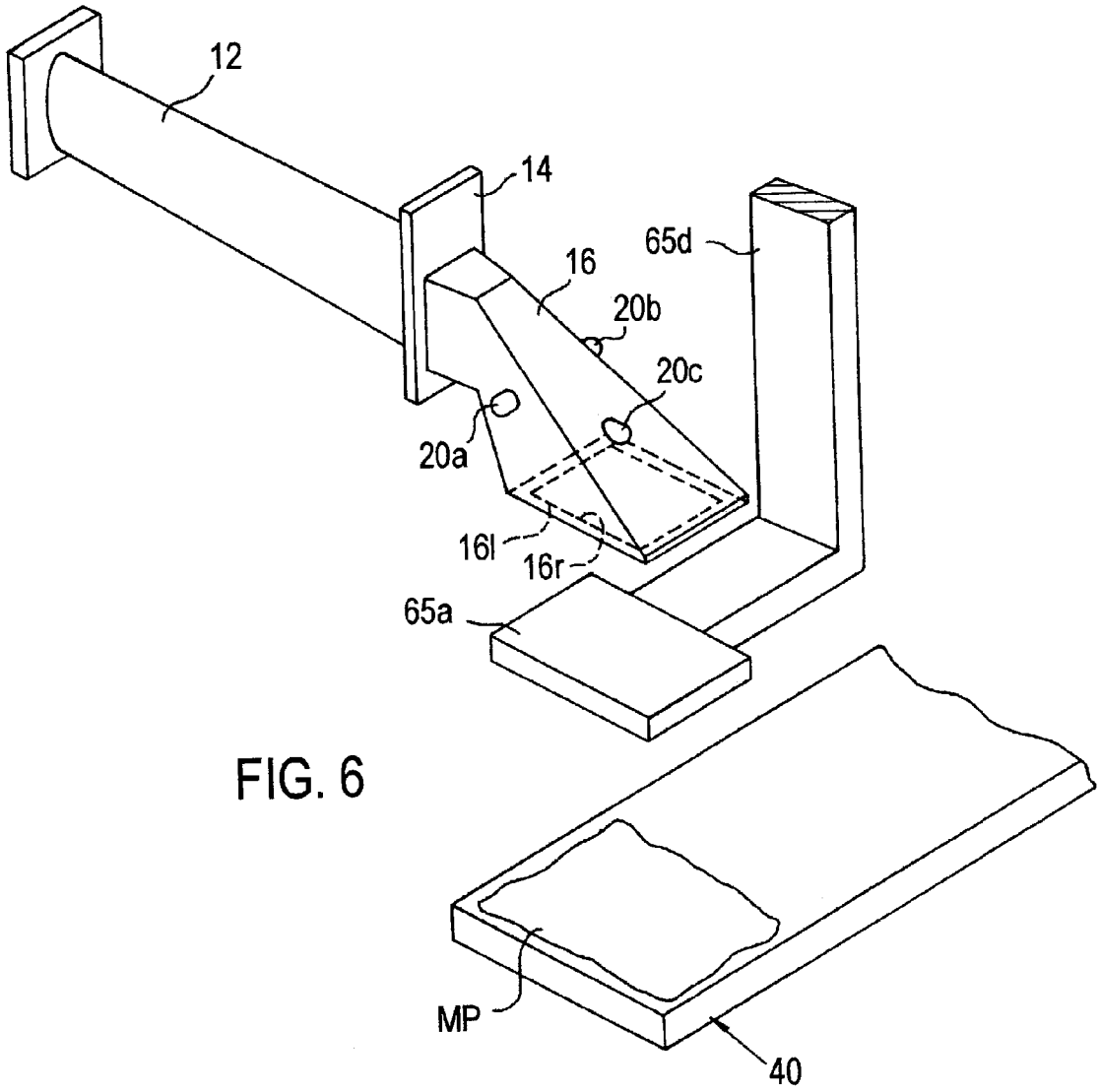
FIG. 6 is perspective view of the runner bar, gating region of the pattern and heating iron pivoted therebetween.

For example, the gating region 16 of each pattern 10 includes a flat planar attaching surface 16*a* adapted for attachment to a surface 40*a* of a fugitive runner support bar 40 as described below. The flat planar attaching surface 16*a* can comprise a flat, narrow peripheral attaching lip 161 extending about an end recess 16*r* molded in the attaching surface 16*a*, FIGS. 6 and 7A. The recess 16*r* is shaped and sized to receive a support member PP on table T, FIG. 1.

The pattern gating region 16 includes first and second locator embossments 20*a*, 20*b* on opposite side surfaces 16*s*1 and 16*s*2 that extend perpendicular to the attaching surface lip 16*l* on the gating region 16. The first and second embossments 20*a*, 20*b* are coaxial and define a first axis A1. The embossments 20*a*, 20*b* are illustrated as being defined by partial spherical surfaces 20*s* such that the axis A1 extends through the centers of the partial spherical surfaces. A third locator embossment 20*c* is disposed on a lateral surface 16*k* extending between the opposite side surfaces 16*s*1, 16*s*2 of the gating region 16. The third embossment 20*c* defines a second axis A2 that is coplanar and perpendicular to the first axis A1. The embossment 20*c* is illustrated as being defined by a partial spherical surface 20*s* such that the axis A2 extends through the center of the partial spherical surfaces.

The three locator embossments 20*a*, 20*b*, 20*c* are disposed in a triangular array and define a reference plane P1, FIG. 7A, that is parallel to the plane defined by the attaching surface lip 16*l* and is positioned parallel to the plane P2 determined for surface 40*a* of the fugitive runner bar 40 during attachment of the pattern attaching surface 16 to the flat planar runner bar surface 40*a* as described below. The invention is not limited to the particular array of locator embossments 20*a*, 20*b*, 20*c* illustrated as other arrays and numbers of embossments thereof can be employed as needed in a particular lost wax investment casting application for a particular article to be cast.

Figure 7A:
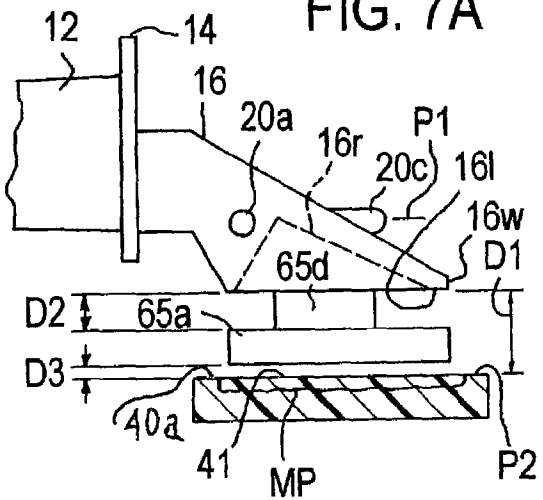
FIGS. 7A, 7B, and 7C are partial elevational views, partially in section, showing the sequence of motions of the pattern to space the gating region from the runner bar (FIG. 7A), to submerge the gating region a small distance in the melted puddle (FIG. 7B), and withdraw the gating region in the melted puddle to form a rounded filleted corner on the joint (FIG. 7C).
Figure 7B:
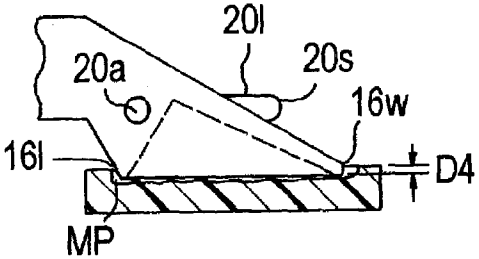

The locator embossments 20*a*, 20*b*, 20*c* each are configured to have a relatively short cylindrical section 201 that terminates in partially spherical end surface 20*s*, FIG. 7B. The dimensions of the embossments are selected so as to be grippable by gripper device 60 pursuant to the invention coupled to the articulated arm 30*a* of the robotic device 30. The end surfaces 20*s* can have a shape other than partially spherical such as for example only conical, polyhedral, and parabolic. The locator embossments are illustrated as projections from the pattern gating 16, but alternatively the locators 20*a*, 20*b*, 20*c* could be shaped as recessed pockets or concavities extending inwardly into the pattern gating.

Figure 2:
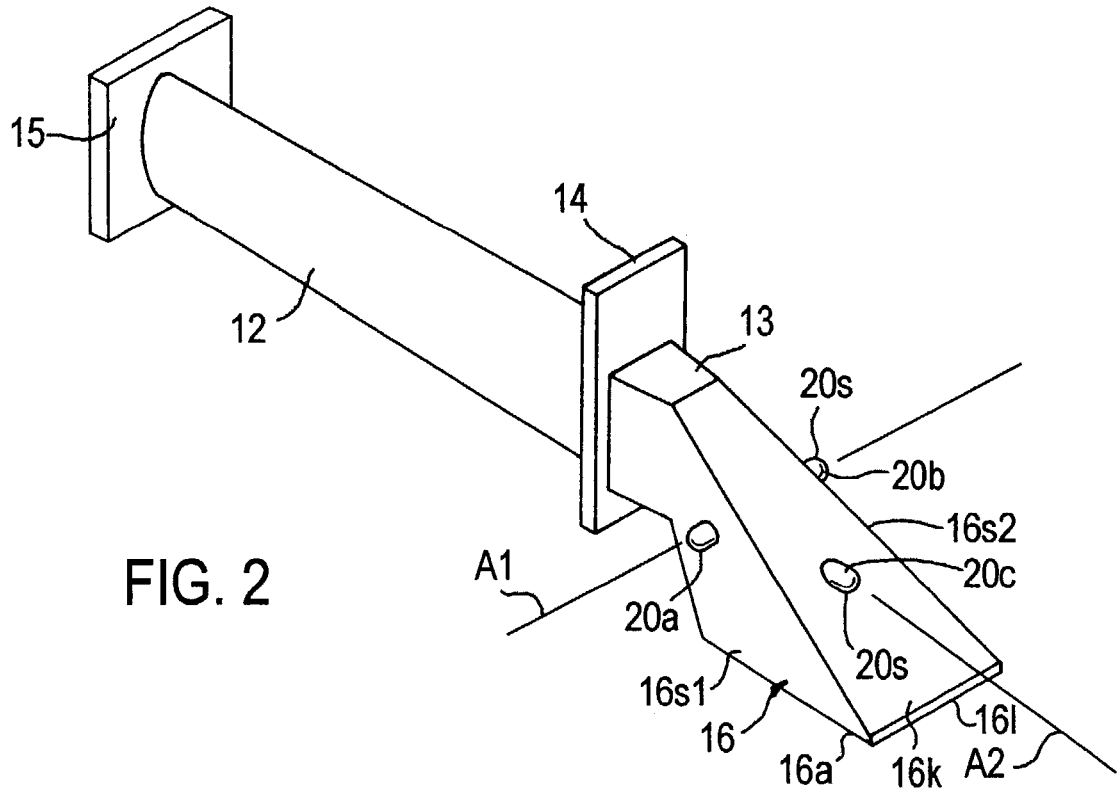
FIG. 2 is a perspective view of a pattern having locator embossments thereon for gripping by a gripper device pursuant to the invention on the motion arm of the robotic device.

The datum locator embossments 20*a*, 20*b*, 20*c* pursuant to an illustrative embodiment of the invention are injection molded integrally on each pattern 10 in a conventional die cavity (not shown) machined to have the shape and features of the pattern 10 described above as well as to include cavities corresponding in size, shape and location to the datum embossments to be formed on the gating region 16. Each pattern 10 is formed by injecting molten pattern wax (or other fugitive material) into the die cavity where the wax solidifies to produce pattern 10 as is well known in the lost wax investment casting art. The injection molded wax pattern 10 includes the datum embossments 20*a*, 20*b*, 20*c* molded integrally with and on the gating region 16 thereof as shown in FIGS. 1 and 2.

Preferably, the datum locator embossments 20*a*, 20*b*, 20*c* are located on the gating region 16, or other portion, of each pattern 10 that will be removed from the final metallic casting made to replicate the pattern. For example, the datum embossments preferably are located on the gating region 16 such that the metallic gating is cut-off from the final casting (e.g. from the root region 13) in one step cut-off operation.

In addition to the datum locator embossments 20*a*, 20*b*, 20*c* on the gating region 16, each pattern 10 may also include another similar set of datum locator embossments (not shown) at another gating region in the event that the pattern 10 will include dual gating regions; e.g. the gating region 16 associated with the root region 13 and another similar gating region (not shown) associated with the shrouded blade tip region 15.

Referring to the Figures, a method of making a fugitive pattern assembly pursuant to the invention for use in the lost wax investment casting process is illustrated. For example, assembly of the fugitive patterns 10 on the generally flat surface 40*a* of the runner support bar or member 40 fixtured on a table T is illustrated. The runner support bar 40 includes flat bar region 40*b* with flat major surfaces 40*a*, 40*a*' on opposite sides of the bar region. The bar region 40*b* is connected to an integral conical pour-cup attaching region 40*c*. The pour cup-attaching region 40*c* includes a threaded insert 40*d* fixedly embedded therein during wax molding of bar 40. Alternately, the pour cup-attaching region 40*c* can be separate and attached to bar region 40*b* by wax welding. Referring To FIGS. 1, 1A, 1B, and 1C, a fixture 31 is provided having a central truncated conical clamp 32 against which shoulder 40*e* of the pour cup-attaching region 40*c* is drawn and clamped by a bolt knob 33 having threaded member 33*a* threaded into the insert 40*d* as shown best in FIG. 1B. The fixture 31 also include legs 34, 35 having V-notches 34*a*, 35*a* on the edges such that longitudinally spaced apart partial spherical embossments 40*s* molded on the facing minor side of the bar region 40*b* are received and held in the notches when the pour-cup-attaching region 40*b* is clamped in clamp 32, FIG. 1C. The table T has affixed thereto an upstanding lower yoke section Y1 which is configured to receive the exterior of clamp 32 of the fixture. An upper yoke section Y2 is fastened on the lower yoke section Y1 to secure and clamp the clamp 32 of fixture 31 on the table T. The bar region 40*b* is suspended above the table T by the yoke sections Y1, Y2 and fixture 31 with surface 40*a* generally parallel with the plane of the table T. The invention is not limited to any particular fixturing for the runner support bar 40 as other fixturing devices can be used.

A plurality of fugitive patterns 10 are shown disposed at a pick-up location PL on the table T. Each pattern 10 is supported on the table T by an epoxy (or other material) plate PP that is shaped and sized to be received in the end recess 16*r* of the pattern attaching surface 16*a* to support the pattern with the plane P1 parallel to the plane of the table T.

The robotic motion device 30 on the table T includes articulated arm 30*a* with gripper device 60 pursuant to an embodiment of the invention. Each pattern is individually picked up by the gripper device 60 and positioned in proximity to the runner bar surface 40*a* for attachment thereto. The robotic device 30 can be a conventional robot of the 6-axis type available as model K3 from Motoman Inc. a part of Yaskawa Corporation, 805 Liberty Lane, W. Carrollton, Ohio 45449.

The gripper device 60 is adapted to pick up each pattern 10 at locator embossments 20*a*, 20*b*, 20*c* so that the arm 30*a* of robotic device 30 can orient each pattern attaching surface 161 (which is parallel to plane Pi defined by embossments 20*a*, 20*b*, 20*c*) parallel to the runner bar surface 40*a* during attachment thereto as described below. To this end, the gripper device 60 includes a mounting plate 62 that carries a conventional coupling 64 for connection to the articulated arm 30*a* of the robotic motion device 30. A second, downwardly extending mounting plate 66 is fastened to mounting plate 62. First and second gripper arms 72, 74 are mounted on plate 66. The first gripper arm 72 is fixedly mounted by fasteners on plate 66, while the second gripper arm 74 is fastened to rod 75*a* of a fluid (e.g. pneumatic) cylinder 75. Cylinder 75 is mounted on fixed support plate 73 that is fastened on downwardly extending plate 66. The gripper arm 74 is linearly moved by fluid cylinder 75. The cylinder 75 is actuated via opening/closing of a fluid (e.g. air) valve 77 that is communicated to compressed air source C as controlled by robot control unit 100 and to an air conduit on arm 30*a* that extends to cylinder 75.

The gripper arms 72, 74 each include an embossment-engaging conical recess 72*a*, 74*a* adapted to receive the side embossments 20*a*, 20*b* on the gating region 16 of each pattern 10. The recesses 72*a*, 74*a* are coaxial when the arms 72, 74 receive and grip the embossments 20*a*, 20*b*.

Figure 4C:
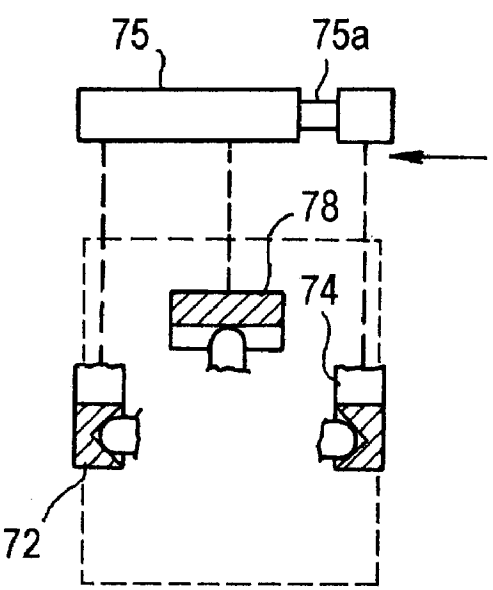
FIGS. 4A, 4B, 4C are schematic views illustrating capture of the gating region of the pattern by the gripper device.
Figure 4B:
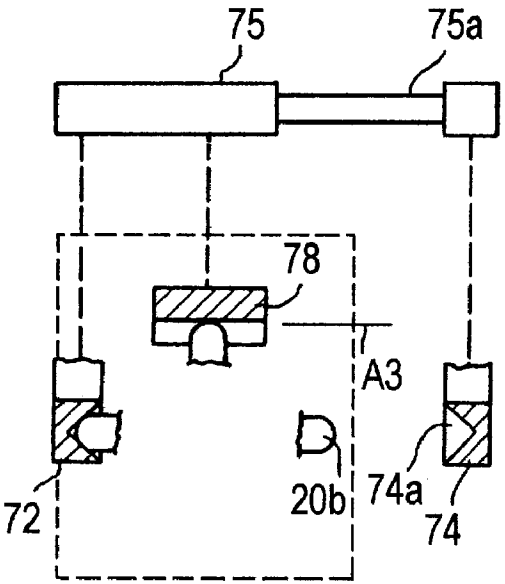

A third fixed gripper arm 78 is fastened by fasteners on fixed plate 66 and includes a notch 78*a* which can have a partial cylindrical shape or V shape to receive the embossment 20*c* of the gating region 16 of the pattern. The axis A3 of the notch 78*a*, FIG. 4B, is parallel to the axis A1 and perpendicular to axis A2 and resides in plane P1.

If the patterns 10 have locators 20*a*, 20*b*, 20*c* in the form of shaped recessed pockets or concavities, then gripper arms 72, 74, 78 will be appropriately modified to include pick-up projections, in lieu of recesses 72*a*, 74*a* and notch 78*a*, to enter the locator pockets or concavities in a manner to enable the gripper device to pickup each pattern 10.

Figure 3A:
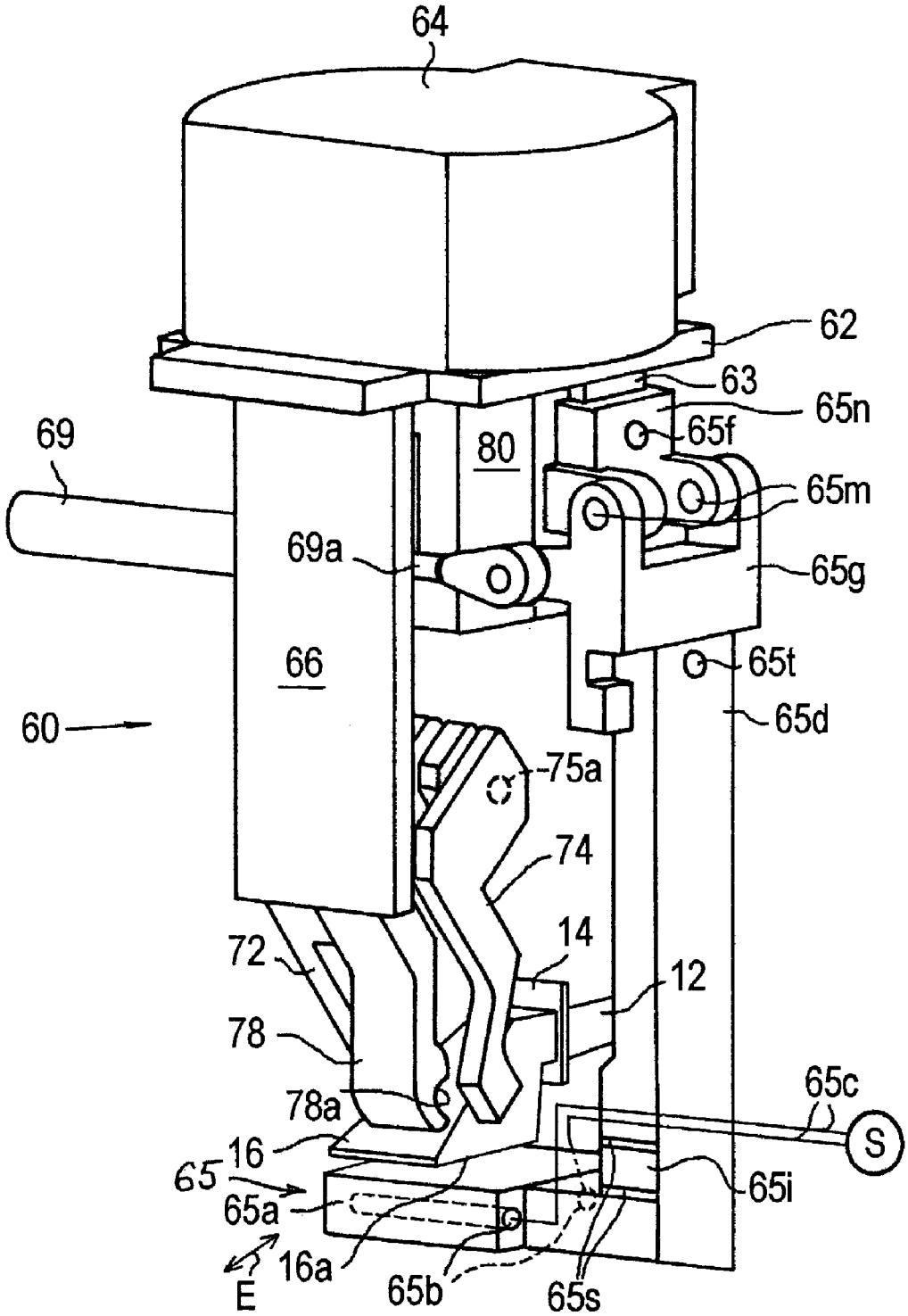
FIGS. 3A and 3B are front and rear perspective views of the gripper devicehaving a radiant heating device and distance sensor.

The gripper device includes a heating device 65 comprising a radiant metal (e.g. aluminum) heating iron 65*a* having electrical resistance heating elements 65*b* received in passages on each side of the iron 65*a*, FIG. 3A. The heating elements 65*b* are connected by electrical power wires 65*c* to a source S of electrical power, which is switched on and off by a stationary temperature controller (not shown), such as an Omron E5AX controller available from Omron Electronics, One E Commerce Drive, Schaumburg, Ill. 60173. The power wires 65*c* are loosely carried on the robotic arm 30*a* to source S, which can be locate external of the robotic motion device 30 (e.g. beneath table T). When the elements are electrically energized, they heat the heating iron 65*a* in a manner similar to a soldering iron.

The radiant heating iron 65*a* is disposed and carried on a depending arm 65*d* and is adjustable in a lateral direction E by sliding arm 65*d* along bracket 65*g*. Arm 65*d* and bracket 65*g* are releasably fastened by one or more fasteners 65*t* to this end. Arm 65*d* is adjustable up and down by sliding mounting block 65*n* on slideway 63 attached to plate 62 and held in position by one or more fasteners 65*f*. Thermal insulating member 65*i* is disposed between heating iron 65*a* and the arm 65*d* with thermally insulating gasket material (e.g. insulation wool) 65*s* applied between each side of insulating member 65*i*. Multiple fasteners (not shown) extend upwardly through the heating iron 65*a*, insulating member 65*i*, and gasket material 65*s* into the bottom of the arm 65*d* to fasten them together. Heating elements 65*b* other than electrical resistance elements can be used in practice of the invention.

Figure 5:
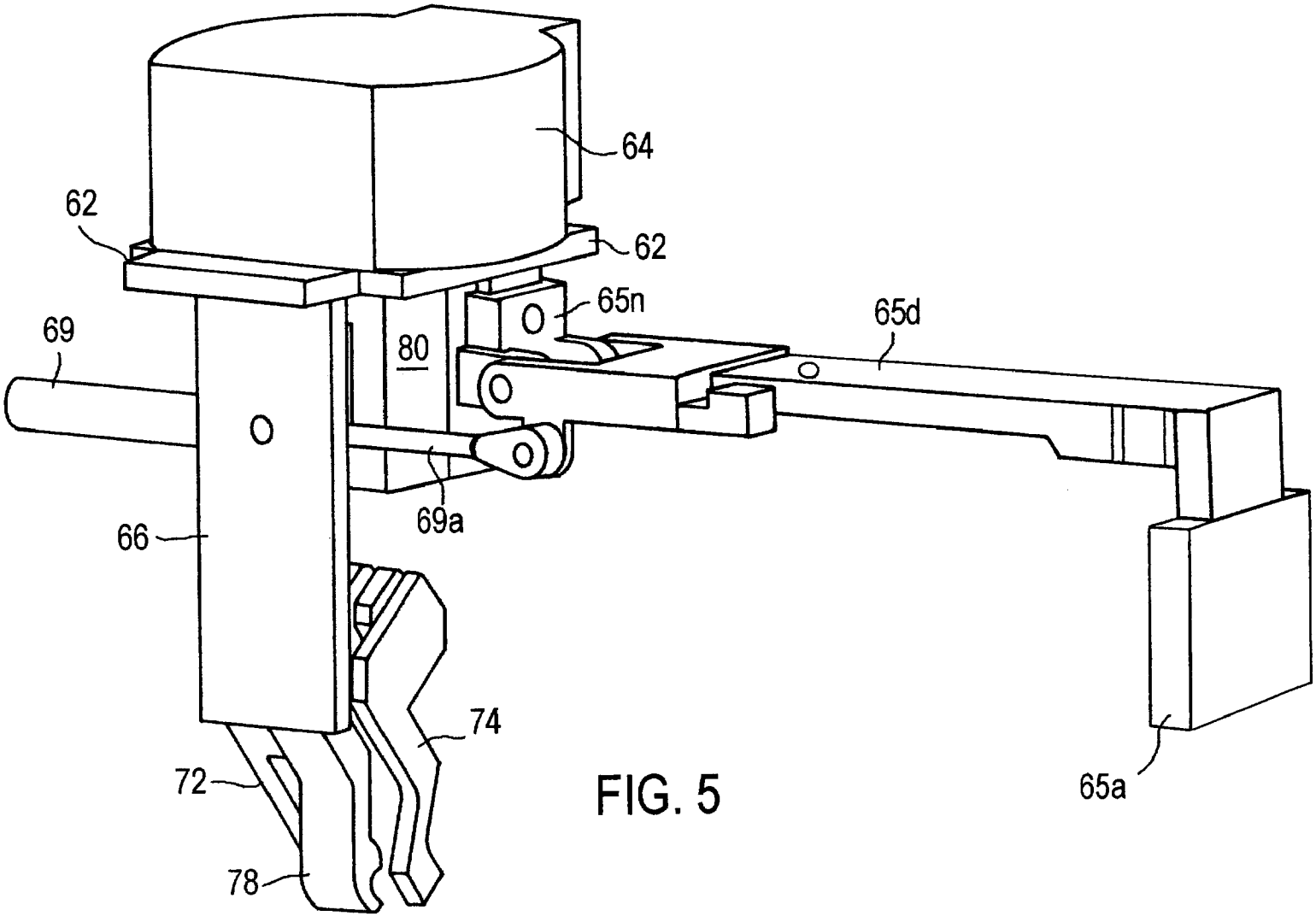
FIG. 5 is a perspective view of the gripper device showing the heating device pivoted away from the gripper arms.

The bracket 65*g* is bifurcated and mounted by a pair of pivot pins 65*m* to mounting block 65*n*. The heating device 65 thereby is pivotally mounted for movement between a stowed position shown in FIGS. 1 and 5 and a working position shown in FIG. 3A, 6 and 7A. The heating iron 65*a* is moved between these positions by an actuator such as a fluid (e.g. pneumatic) actuator 69 fastened on bracket 67 itself fastened to plate 66. The cylinder rod 69*a* of cylinder 69 is connected to the bracket 65*g* as shown. The cylinder 69 is actuated via opening/closing of a fluid (e.g. air) valve 71 that is communicated to source C of compressed air (or other fluid) as controlled by robot control unit 100 and to an air conduit on arm 30*a* extending to cylinder 69.

Figure 3B:
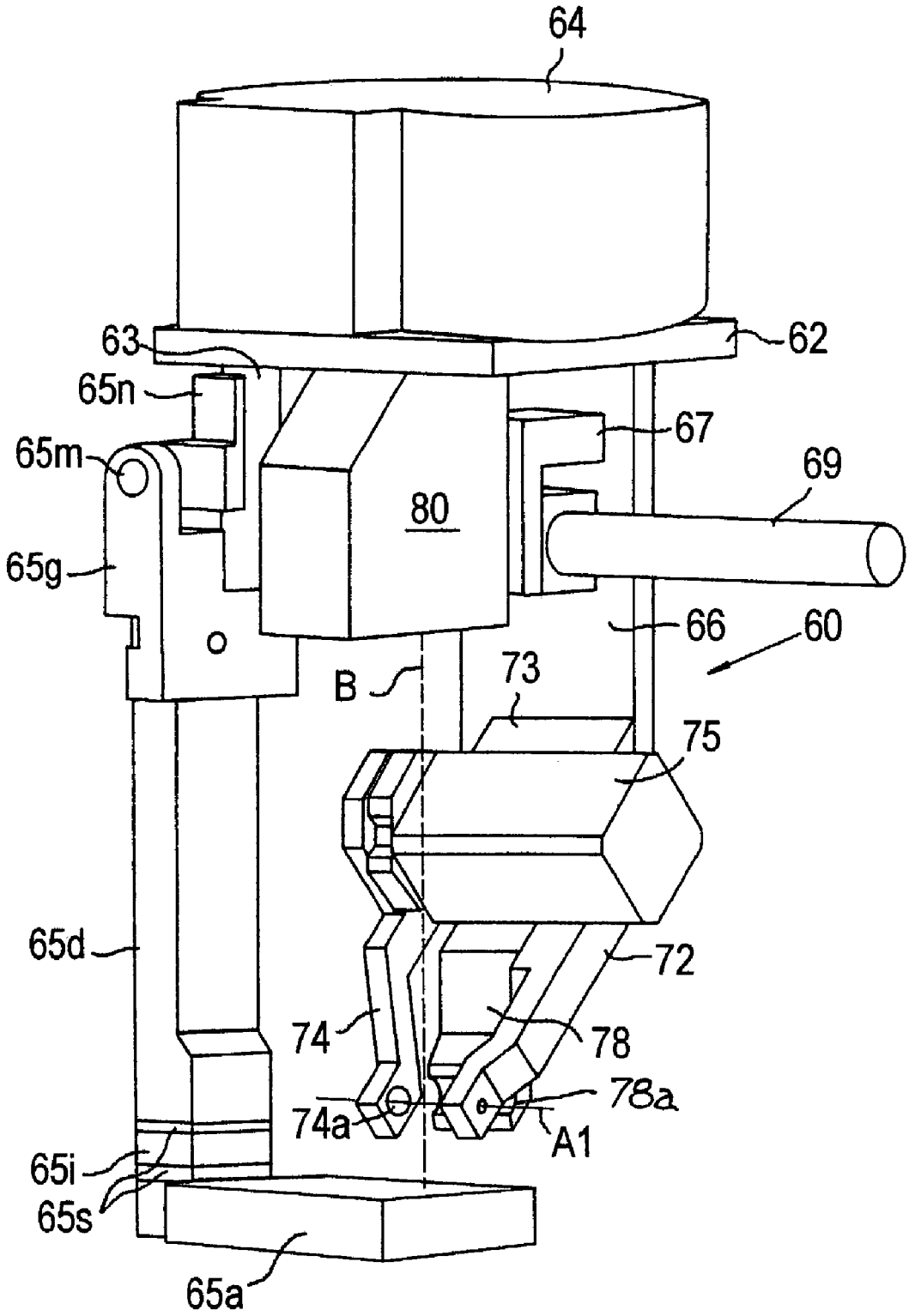
Figure 3C:
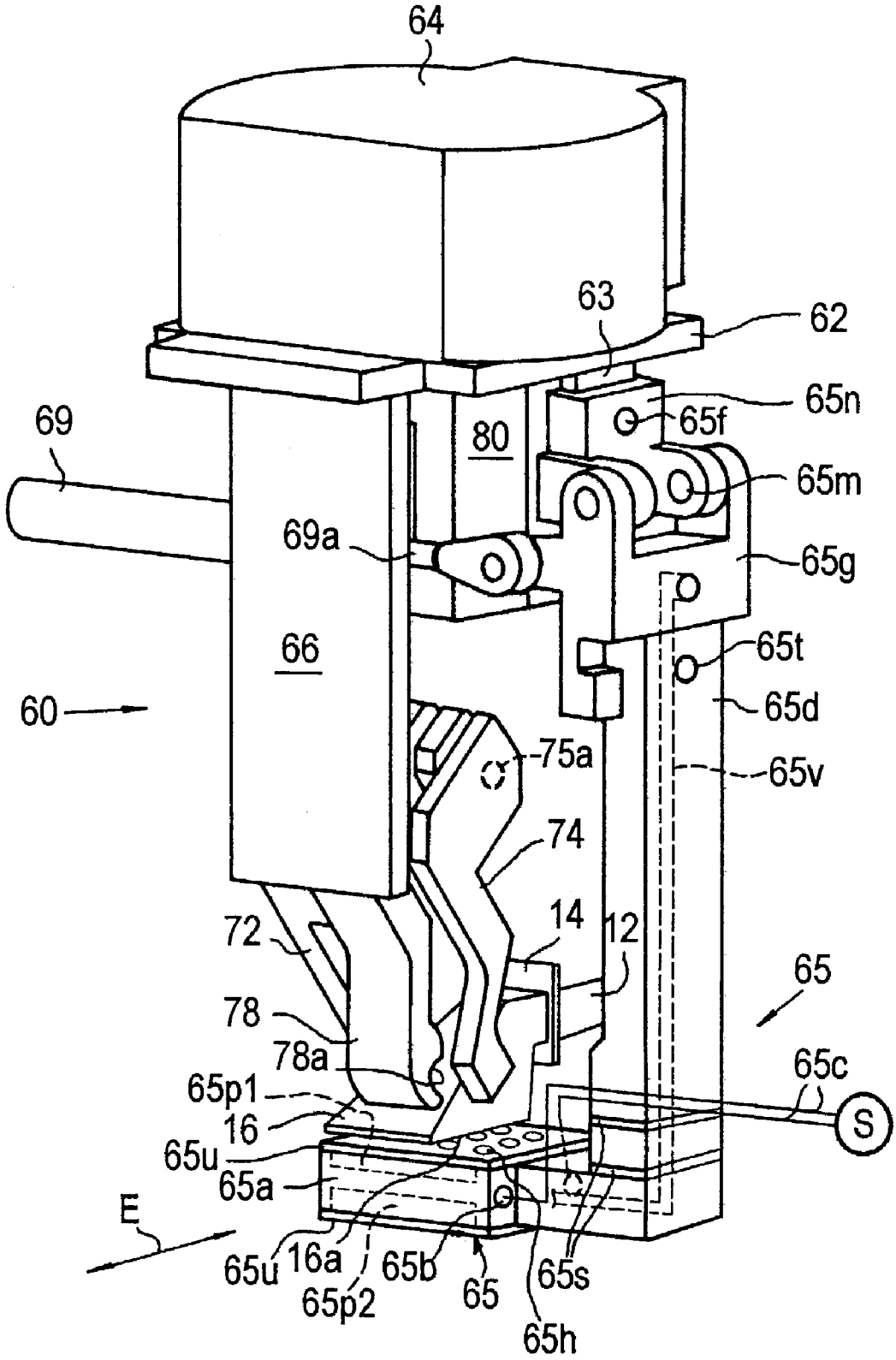
FIG. 3C is front perspective view of an alternative gripper device having a hot air heating device.

In lieu of radiant heating iron 65*a*, the heating device 65 can comprise a forced hot air heating device, FIG. 3C, where the heating iron 65*a* is hollowed out to include two plenums 65*p*1, 65*p*2 into which compressed air is supplied for discharge through a plurality of apertures 65*h* in end plates 65*u* disposed on opposite major sides of the iron 65*a* to close off and communicate to the respective plenums via apertures 65*h* in the plates. Electrical resistance heating elements 65*b* can be disposed in the plenums or outside in the body of iron 65*a*. The compressed air is supplied to the plenums through a passage 65*v* in arm 65*d* or a conduit (not shown) on arm 65*d* connected to a source of compressed air, such as shop air. The supply of compressed air to the plenums can be controlled by robot control unit 100 programmed to open/close one or more air control valves (not shown) at appropriate times. The air flow through the apertures 65*h* on bottom plate 65*u* is used to heat the surface 40*a* of the runner bar 40 to form puddle MP, while the hot air flow through the apertures 65*h* on top plate 65*u* is used to heat the surface lip 161 of the pattern 10 prior to their being joining together.

The gripper device 60 includes a commercially available laser distance sensor 80 that directs a laser beam B downwardly in a direction that passes through the intersection of axis Al and axis A2, FIG. 3B. The sensor 80 is used to determined the orientation of the particular surface area 41 of runner bar surface 40*a* where each pattern is to be attached as described below. A suitable laser sensor is available from Omron Electronics, One E Commerce Drive, Schaumburg, Ill. 60173.

Pursuant to a method embodiment of the invention, the patterns 10 are positioned on flat, horizontal table T at pick-up location PL so that the plane P1 defined by embossments 20*a*, 20*b*, 20*c* resides generally in a horizontal plane parallel with the plane of the table T. The supports PP are used to this end as described above.

Figure 8:
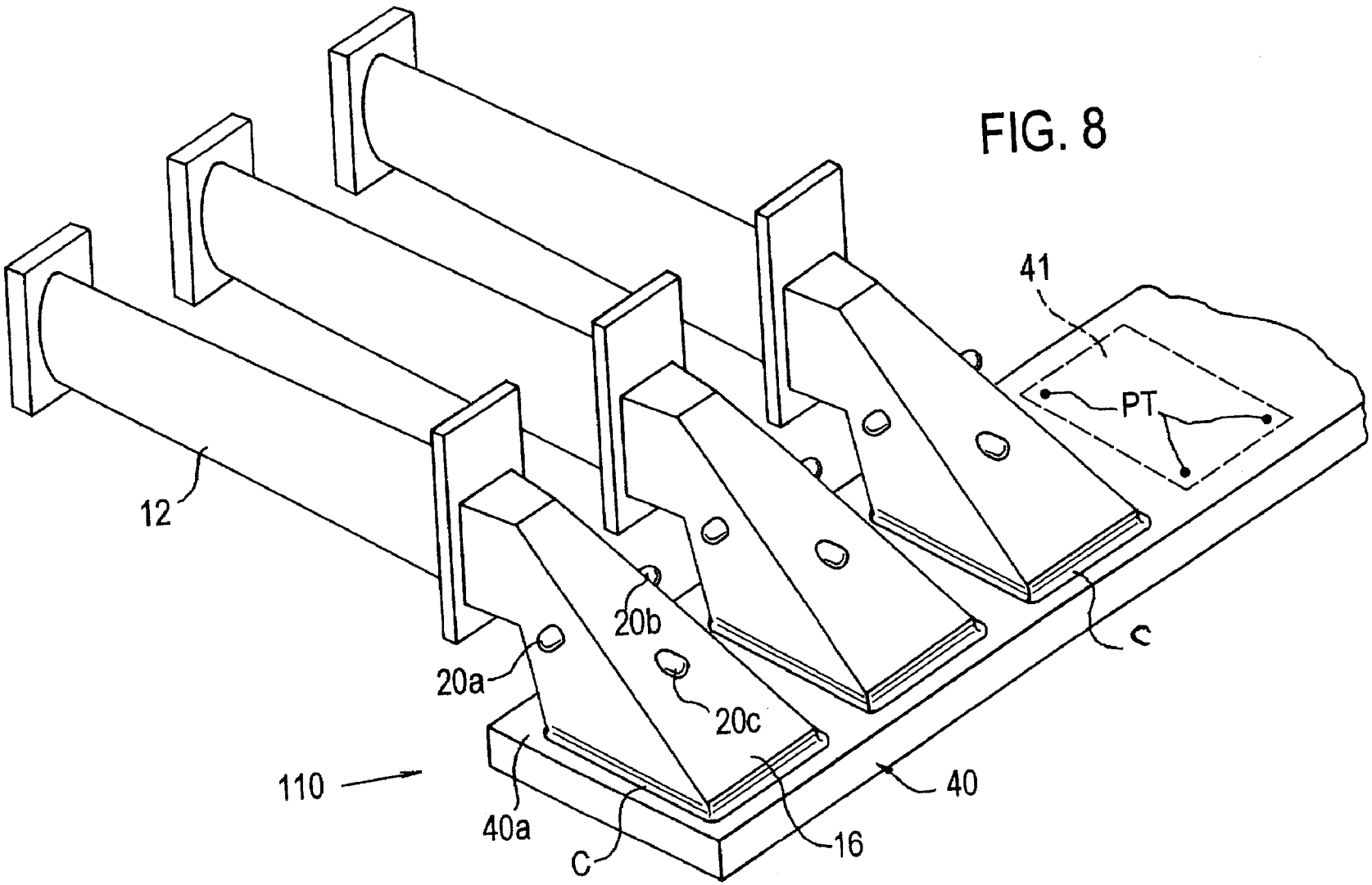
FIG. 8 is a perspective view of multiple patterns welded onto the runner bar with smooth filleted corners at the joints.

Prior to picking up each pattern at location PL on the table, the sensor 80 on the gripper device is moved over the area 41 of surface 40*a* where the pattern 10 will be attached to the support member 40 by the robotic motion device, FIG. 8. The sensor 80 determines a planar orientation of the area 41 by measuring the distance between the sensor and multiple points (e.g. see 3 points PT for a Cartesian coordinate system in FIG. 8) on the particular area 41. From this data, the robot control unit 100 determines a planar orientation of the area 41 (e.g. angle of surface area 41 relative to horizontal) and stores the planar orientation in robot control memory 102. Software systems for determining planar orientation in this manner are available commercially and provided on the above described commercially available robotic device 30.

Figure 7C:
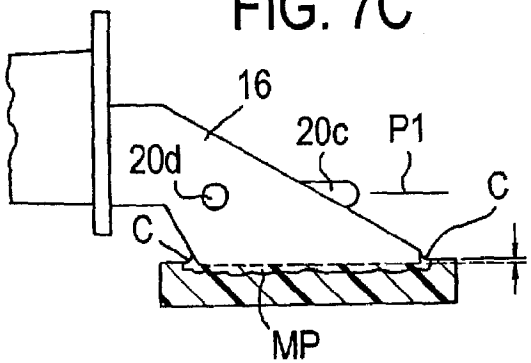
Figure 7D:
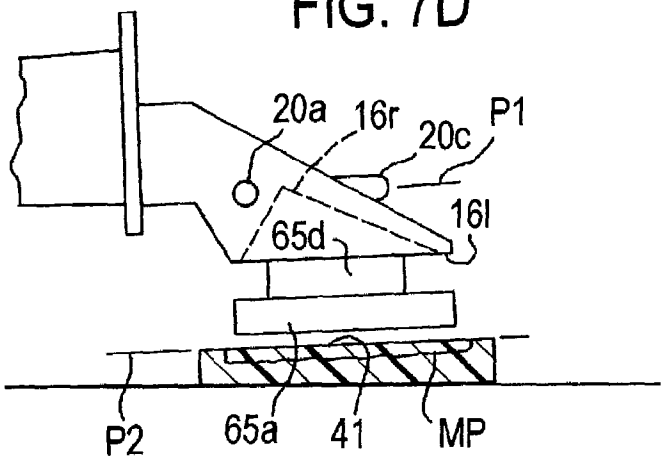
FIG. 7D is a partial elevational view, partially in section, showing the pattern orientation parallel to a runner bar surface having a tilted planar orientation.

Determination of the planar orientation of the surface area 41 of the runner bar 40 in the manner described is practiced pursuant to an embodiment of the invention as a result of the uneven nature of surface 40*a* of the runner bar 40 as injection molded. For example, the surface 40*a* of the runner bar 40 typically exhibits unevenness along its length and across its width such that particular areas 41 are not level with one another. FIG. 7D illustrates a tipped surface area 41 on runner bar 40 for example, the tilted surface area 41 not being horizontal. If the runner bar 40 can be produced or modified (e.g. machined) to have a perfectly flat surface 40*a* and oriented parallel to the plane of the table by fixture 31 and yokes Y1, Y2, then the step of determining planar orientation of each respective surface area 41 and step of storing the orientation in robot control memory 102 may be omitted.

Figure 4A:
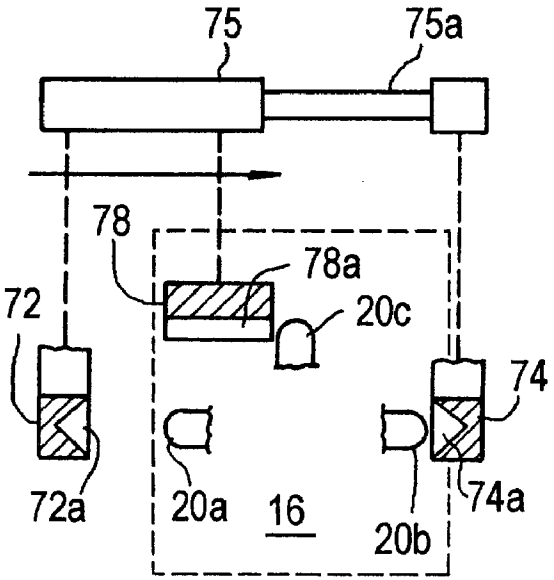

Otherwise, after the robotic device 30 determines the planar orientation of the area 41 on surface 40*a*, it manipulates the gripper device 60 to pick up a pattern 10 for movement and attachment to the area 41 on runner bar 40. For example, the gripper device 60 first is moved in direction of the arrow in FIG. 4A until the fixed gripper arms 72 and 78 are positioned to receive the embossments 20*a*, 20*c*, FIG. 4B. The sensor 80 can be used to confirm that a pattern 10 is in position to be picked-up. Then, the movable gripper arm 74 is moved linearly by cylinder 75 toward the embossment 20*b* until the embossment 20*b* is received in the recess 74*a* thereof, FIG. 4C. In this way, the arms 72, 74 and 78 securely capture the coplanar embossments 20*a*, 20*b*, 20*c* of the gating region 16 of each pattern 10. The robot control unit 100 controls air valve 77 to actuate cylinder 75.

The pattern 10 is lifted from the pick-up location PL by the robotic arm 30*a* while the gripper device 60 holds the gating region 16 at the locator embossments and is moved to the surface area 41 where its attaching surface lip 161 will be attached to the surface 40*a* of the runner support bar 40 held in fixtue 31 and yokes Y1, Y2. The pattern attaching surface lip 16*l* is placed by robotic arm 30*a* in proximity to and facing surface area 41 of runner bar 40 as illustrated in FIG. 7A. For example, distance D1 can be 1 inch.

Since the planar orientation of the surface area 41 is stored in robot control memory 102, the robotic arm 30*a* is manipulated to orient the pattern attaching surface 16*a* of the pattern 10 on gripper device 60 so as to have substantially the same orientation as the sensed and stored planar orientation of surface area 41. That is, the pattern attaching surface lip 16*l* is oriented to be substantially parallel to the sensed plane defined by surface area 41 on the runner bar 40, see FIG. 7A for a horizontal surface area 41 and see FIG. 7D for a tipped out of horizontal surface area 41.

Heating device 65 then is pivoted from its stowed to its working position between the pattern attaching surface lip 16*l* and runner bar surface area 41 in proximity to each surface (e.g. distances D2=0.3 inch and D3=0.025 inch), FIG. 7A. The heating iron 65*a* is electrically energized for a time to maintain a constant iron temperature (e.g. 700 degrees F.) that radiantly heats the surfaces to melt a puddle MP of the fugitive (e.g. wax) material on the surface area 41 of the runner bar 40 and to soften but not melt the pattern attaching surface lip 16*l*. The puddle MP has a general configuration corresponding to the shape of the heating iron 65*a* and pattern attaching surface lip 16*l* with the puddle larger in size. For purposes of illustration only, the melted puddle MP can have a depth of 0.050 inch. The heating iron then is quickly moved by cylinder 69 back to its stowed position on the gripper device 60. The pattern is lowered by robotic arm 30*a* to lower attaching surface lip 16*l* into the puddle MP to a preselected depth D4 (e.g. 0.030 inch depth) to wet the upstanding edges 16*w* of the gating region 16 extending about the attaching surface 16*a* (i.e. lip 16*l*) with the melted puddle material, FIG. 7B. The pattern then is raised by arm 30*a* to move attaching surface lip 161 in the opposite direction in the puddle MP to a preselected lesser depth (e.g. 0.010 inch) to form a smooth filleted corner C at the junction between the pattern gating 16 and the runner bar surface 41*a*, FIG. 7C. The pattern is held in this position by the robot arm 30*a* until the melted fugitive material solidifies to complete the final joint between the pattern gating 16 and the runner bar surface 40*a*. Joints formed in this manner are characterized by improved strength and absence of stress-raising sharp corners with no dimensional distortion of the patterns 10.

The gripper device 60 then is released from the pattern 10 now joined to the runner bar 40 by first moving gripper arm 74 away from and out of engagement with locator embossment 20*b* and manipulating the robotic arm 30*a* to move the gripper arms 72, 78 away from and out of engagement with locator embossments 20*a*, 20*c* such that the gripper device 60 can be moved by robotic arm 30*a* back to pick-up location PL to pick-up the next pattern 10 to be joined to the runner bar 40. The above pattern moving and attaching steps are repeated to attach the next and each successive pattern 10 to a different surface area 41 on the runner bar 40 to form a pattern assembly 110 having a plurality of patterns 10 joined to the runner bar 40, FIG. 8.

The robotic motion device 30 is programmed to move the arm 30*a* and gripper device 60 to effect motions of the gripper device 60 described above and to effect actuation of the fluid cylinder 69 for the pivotal arm 65*d* of the heating device 65 and the fluid cylinder 75 for the linearly movable arm 74 of the gripper device 60.

Although the illustrative embodiment of the invention described above involves moving each pattern 10 toward the melted puddle MP to form the joint J, the invention envisions any combination of relative movement between the pattern and the runner bar to contact the pattern attaching surface 16*a* and the melted puddle MP. For example, the runner bar 40 may be disposed on a secondary table (not shown) that is disposed on table T and that is movable up and down to this end.

After the patterns 10 are attached to the surface 40*a* of the runner support bar 40, the fixture 31 can be removed from the yokes Y1, Y2, and the runner bar 40 with fixture 31 thereon reoriented to orient the opposite surface 40*a*' of the bar region 40*b* to face upwardly. The fixture 31 then is reclamped between the yokes Y1, Y2 so that patterns 10 can be attached to surface 40*a*' in the same manner as described above for surface 40*a* to complete a pattern assembly 110. After the pattern assembly 110 comprising patterns 10 attached to surfaces 40*a*, 40*a*' of runner bar 40 is completed, a wax (or other fugitive material) pour cup (not shown) typically is attached to the pour cup-attaching region 40*c*. The pattern assembly with pour cup then is invested in ceramic to form a ceramic shell mold about the pattern assembly pursuant to the well known lost wax process where the pattern assembly is repeatedly dipped in a ceramic slurry, drained of excess slurry, stuccoed with coarse ceramic particles or stucco, and air dried until a desired thickness of a ceramic shell mold is built-up on the pattern assembly. The pattern assembly then is removed from the green shell mold typically by heating the shell mold to melt out the pattern assembly, leaving a ceramic shell mold which then is fired at elevated temperature to develop appropriate mold strength for casting a molten metal or alloy. When removed from the shell mold, the patterns 10 form the mold cavities to receive molten metal or alloy, while the runner bar forms a molten metal or alloy supply runner to the mold cavities from a pour cup, all as is well known.

Figure 10:
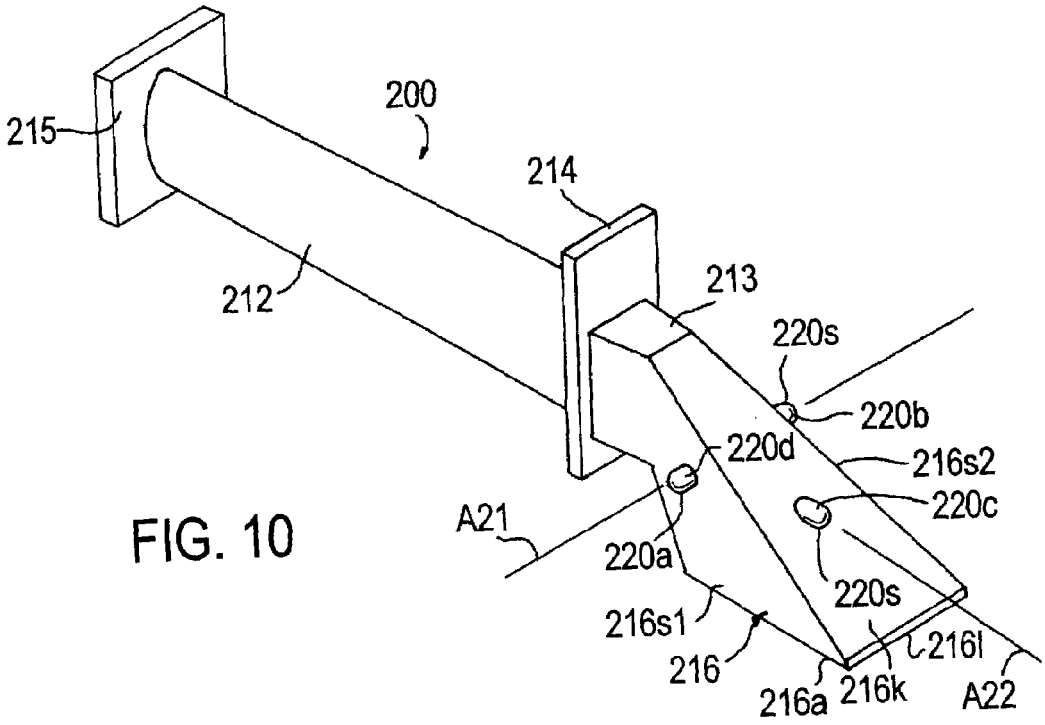
FIG. 10 is a perspective view of casting made using the pattern of FIG. 2 wherein the casting includes locator embossments.

The cast metallic articles 200, FIG. 10, formed in the mold cavities will have a shape (e.g. airfoil blade) replicating that of each pattern 10. Each individual cast article (airfoil blade) 200 includes an airfoil region 212, root region 213, platform region 214, optional shrouded tip region 215, and gating region 216, FIG. 10. The cast metallic articles 200 are each removed from solidified metal or alloy of the runner (that replicates runner bar 40) by a cut-off operation that cuts each gating region 16 off of the runner. Each cast article 200 also will include a plurality of datum locators illustrated as embossments 220*a*, 220*b*, 220*c* disposed in an array on gating region 216 to provide a datum reference system on each cast article by which each cast article can be held and positioned by a manipulator, such as for example a robotic gripper device similar to gripper device 60 employed to move the patterns 10. The cast datum locator embossments provide a datum reference system by which the cast articles 200 can be held and positioned by the robotic gripper device for further processing such as for example grinding, polishing, and inspection of the cast article (blade) 200. The gating region 216 of each cast article 200 is cut-off from the root region 213 at an appropriate time after further processing of the cast articles 200.

The pattern gating region 216 includes first and second locator embossments 220*a*, 220*b* on opposite side surfaces 216*s*1 and 216*s*2 that extend perpendicular to the surface lip 2161 on the gating region 216. The first and second embossments 220*a*, 220*b* are coaxial and define a first axis A21. The embossments 220*a*, 220*b* are illustrated as being defined by partial spherical surfaces 220*s* such that the axis A21 extends through the centers of the partial spherical surfaces. Third embossment 220*c* is disposed on a lateral surface 216*k* extending between the opposite side surfaces 216*s*1, 216*s*2 of the gating region 216. The third embossment 220*c* defines a second axis A22 that is coplanar and perpendicular to the first axis A21. The embossment 220*c* is illustrated as being defined by a partial spherical surface 220*s* such that the axis A22 extends through the center of the partial spherical surfaces. If the patterns 10 have locators 20*a*, 20*b*, 20*c* in the form of shaped recessed pockets or concavities, then each cast article 200 will have an array of datum locators in the shape of recessed pockets or concavities for gripping by a robotic gripper device having gripper arms modified to this end.

The three cast locator embossments 220*a*, 220*b*, 220*c* are disposed in a triangular array and define a reference plane that contains axes A21 and A22 and that is parallel to the plane defined by the surface lip 2161. The invention is not limited to the particular array of embossments 220*a*, 220*b*, 220*c* illustrated as other arrays and numbers of embossments thereof can be employed for a particular cast article.

Figure 9:
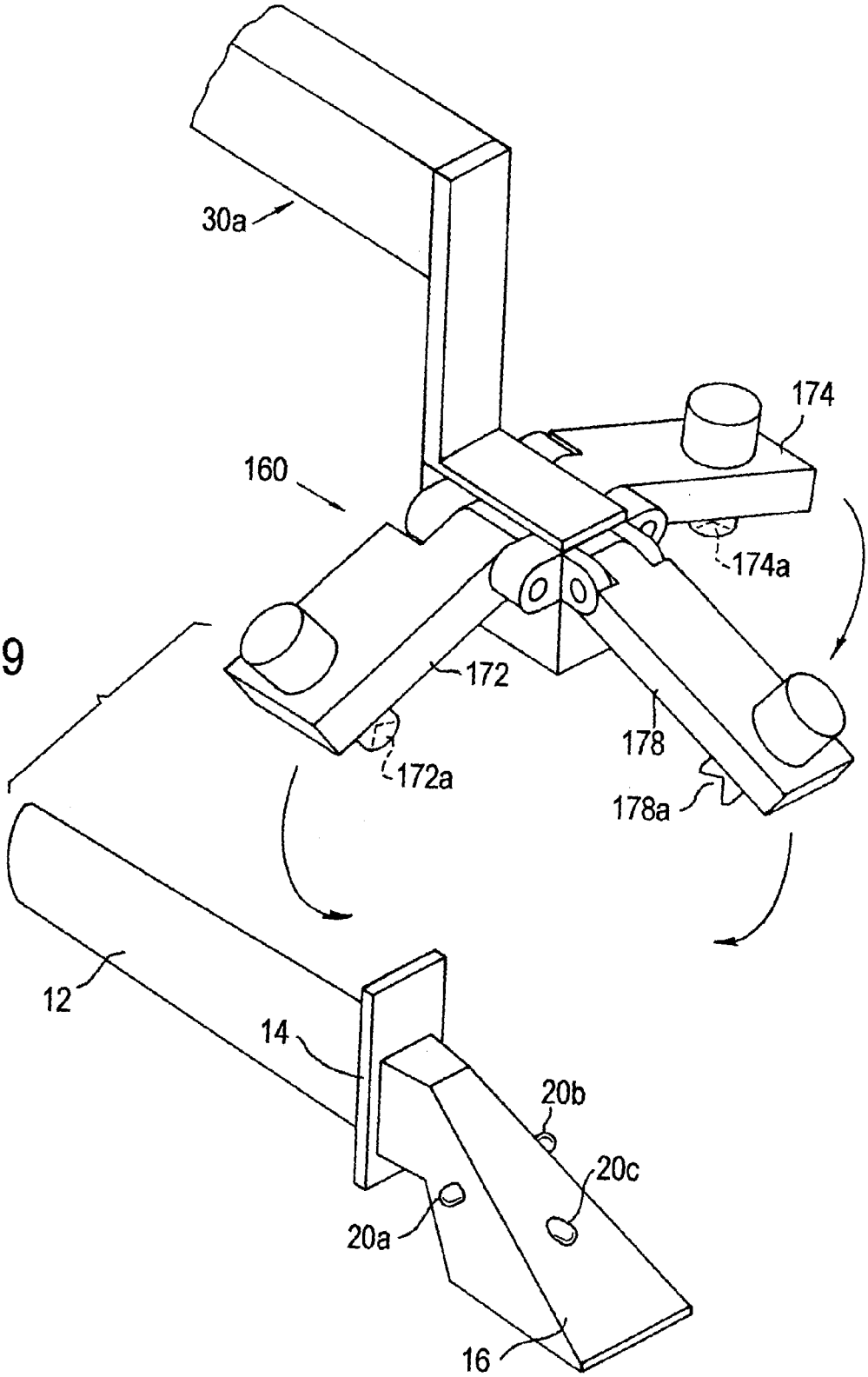
FIG. 9 is a perspective view of the gating region of a pattern having embossments thereon for gripping by a gripper device pursuant to another embodiment of the invention.

Referring to FIG. 9, an alternative gripper device 160 is shown and differs from gripper device 60 in having all three arms 172, 174, 178 disposed on robotic arm 30*a* and pivotable in the directions of the arrows to grip on embossments 20*a*, 20*b*, 20*c* of the gating region 16 of fugitive pattern 10 at aforementioned pick-up location PL. Each arm 172, 174 includes a conical recess 172*a*, 174*a* to receive embossment 20*a*, 20*b*. Arm 178 includes a partial-cylindrical or V-groove 178*a* to receive embossment 20*c*. Each arm can be actuated to pivot by a suitable fluid, electric or other actuator (not shown) mounted on the arm 30*a* and controlled by the computer control unit 100.

Although certain detailed embodiments of the invention are disclosed herein, those skilled in the art will appreciate that the invention is not limited to these embodiments but only as set forth in the following claims.

I claim:

1. A cast metallic article comprising a plurality of locators cast thereon by which the cast article can be held and positioned by a manipulator during further processing, said locators being cast as part of a removable portion of said cast article that ultimately is removed.

2. The article of claim 1 wherein there are three of said locators and wherein two of said locators define a first axis and a third of said locators defines a second axis in a common plane with the first axis and perpendicular thereto.

3. The article of claim 2 wherein said three of said locators include end surfaces that are disposed at corners of a triangular array.

4. The article of claim 1 wherein said plurality of said locators are located on a removable gating region of said cast article.

5. The article of claim 1 wherein each of said plurality of said locators terminates in a partial spherical end surface.

6. The article of claim 5 wherein each of said plurality of said locators includes a cylindrical surface connected to said partial spherical end surface.

7. The article of claim 4 which has an airfoil shaped region, a root region and a tip region, said gating region being connected to one of said root region and said tip region.

8. A cast metallic gas turbine airfoil blade having an airfoil region, root region, and a removable gating region, comprising a plurality of locators all of which are cast as part of the gating region by which locators the cast article can be held and positioned by a manipulator during further processing.

9. The blade of claim 8 wherein there are three of said locators that include end surfaces disposed at corners of a triangular array.

10. The blade of claim 8 wherein there are three of said locators wherein two of said locators define a first axis and a third of said locators defines a second axis in a common plane with the first axis and perpendicular thereto.

* * * * *